US011325405B2

(12) United States Patent
Yada et al.

(10) Patent No.: US 11,325,405 B2
(45) Date of Patent: May 10, 2022

(54) PRINTER WITH PRINT HEAD AND SUPPORT HAVING HEAD SPRING THAT URGES PRINT HEAD

(71) Applicant: FUJITSU COMPONENT LIMITED, Tokyo (JP)

(72) Inventors: Yuji Yada, Tokyo (JP); Masahiro Tsuchiya, Tokyo (JP); Tetsuhiro Ishikawa, Tokyo (JP); Hiromi Ohtsuka, Tokyo (JP); Tatsuya Oguchi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/750,192

(22) Filed: Jan. 23, 2020

(65) Prior Publication Data

US 2020/0238740 A1 Jul. 30, 2020

(30) Foreign Application Priority Data

Jan. 29, 2019 (JP) ..... JP2019-012839

(51) Int. Cl.
*B41J 25/308* (2006.01)

(52) U.S. Cl.
CPC ..... *B41J 25/308* (2013.01)

(58) Field of Classification Search
CPC ..... B41J 2/32; B41J 25/312; B41J 2202/31; B41J 11/04; B41J 11/14
See application file for complete search history.

(56) References Cited

U.S. PATENT DOCUMENTS

| | | | | |
|---|---|---|---|---|
| 5,694,159 | A | 12/1997 | Kajiya et al. | |
| 6,682,239 | B2 * | 1/2004 | Mori | B41J 11/04 347/220 |
| 9,186,904 | B2 * | 11/2015 | Tsuchiya | B41J 11/04 |
| 9,296,220 | B2 * | 3/2016 | Takabatake | B41J 2/3358 |
| 9,545,800 | B2 | 1/2017 | Murata | |
| 2002/0024578 | A1 | 2/2002 | Yamashita | |
| 2006/0291933 | A1 * | 12/2006 | Watanabe | B41J 11/005 400/58 |
| 2008/0180468 | A1 * | 7/2008 | Takahashi | B41J 2/32 346/134 |

(Continued)

FOREIGN PATENT DOCUMENTS

| | | | |
|---|---|---|---|
| CN | 1340420 | 3/2002 | |
| EP | 1108556 A1 * | 6/2001 | B41J 15/042 |

(Continued)

*Primary Examiner* — John Zimmermann
(74) *Attorney, Agent, or Firm* — IPUSA, PLLC

(57) ABSTRACT

A printer includes a print head configured to print on a recording sheet, a platen roller attached to a frame in a rotatable manner, a support having a head spring attached thereto that urges the print head toward the platen roller, and a hold unit attached to the frame in a rotatable manner and having an engaging part that engages with a projection situated at a side end of the support, wherein the head spring is configured to urge the print head toward the platen roller when the projection is engaged with the engaging part, and wherein the hold unit is configured to be rotated to cause the engaging part to disengage from the projection.

4 Claims, 16 Drawing Sheets

(56) References Cited

U.S. PATENT DOCUMENTS

| | | | | |
|---|---|---|---|---|
| 2009/0086006 | A1* | 4/2009 | Koyabu | B41J 2/32<br>347/197 |
| 2011/0074903 | A1* | 3/2011 | Takahashi | B41J 2/325<br>347/198 |
| 2014/0232806 | A1* | 8/2014 | Tsuchiya | B41J 11/04<br>347/197 |

FOREIGN PATENT DOCUMENTS

| | | | | |
|---|---|---|---|---|
| EP | 2042327 | A2 * | 4/2009 | B41J 15/042 |
| EP | 2511100 | A1 * | 10/2012 | B41J 2/32 |
| JP | H02-144454 | | 6/1990 | |
| JP | H07-256978 | | 10/1995 | |
| JP | H09-216436 | | 8/1997 | |
| JP | 2014-210386 | | 11/2014 | |
| JP | 2016-120708 | | 7/2016 | |

* cited by examiner

PRINTER WITH PRINT HEAD AND SUPPORT HAVING HEAD SPRING THAT URGES PRINT HEAD

FIELD

The disclosures herein relate to a printer.

BACKGROUND

A printer prints on a recording sheet sandwiched between a print head and a platen roller.

In a thermal printer, the print head comes in contact with a recording sheet, and may be worn out. In some cases, contamination becomes attached to the heated print head, and is difficult to remove. In such cases, the print head needs to be replaced. However, the print head is urged toward the platen roller by a head spring, and the removal of the print head is not easy. Further, a head spring such as a coil spring is easy to roll, and is easily lost when removing the print head.

Accordingly, it may be desired to provide a printer for which the replacement of a print head is easy.

[Patent Document 1] Japanese Utility Patent Publication No. H02-144454

[Patent Document 2] Japanese Patent Application Publication No. H09-216436

[Patent Document 3] Japanese Patent Application Publication No. 2014-210386

[Patent Document 4] Japanese Patent Application Publication No. H07-256978

[Patent Document 5] Japanese Patent Application Publication No. 2016-120708

SUMMARY

A printer includes a print head configured to print on a recording sheet, a platen roller rotatably attached to a frame, a support having a head spring attached thereto that urges the print head toward the platen roller, and a hold unit rotatably attached to the frame and having an engaging part that engages with a projection situated at a side end of the support, wherein the head spring urges the print head toward the platen roller when the projection is engaged with the engaging part, and wherein the hold unit is configured to be rotated to cause the engaging part to disengage from the projection.

According to at least one of the embodiments, a printer which allows easy replacement of a print head is provided.

DESCRIPTION OF EMBODIMENTS

In the following, embodiments for implementing the invention will be described. The same members or the like are referred to by the same numerals, and a description thereof will be omitted.

Figure 1:
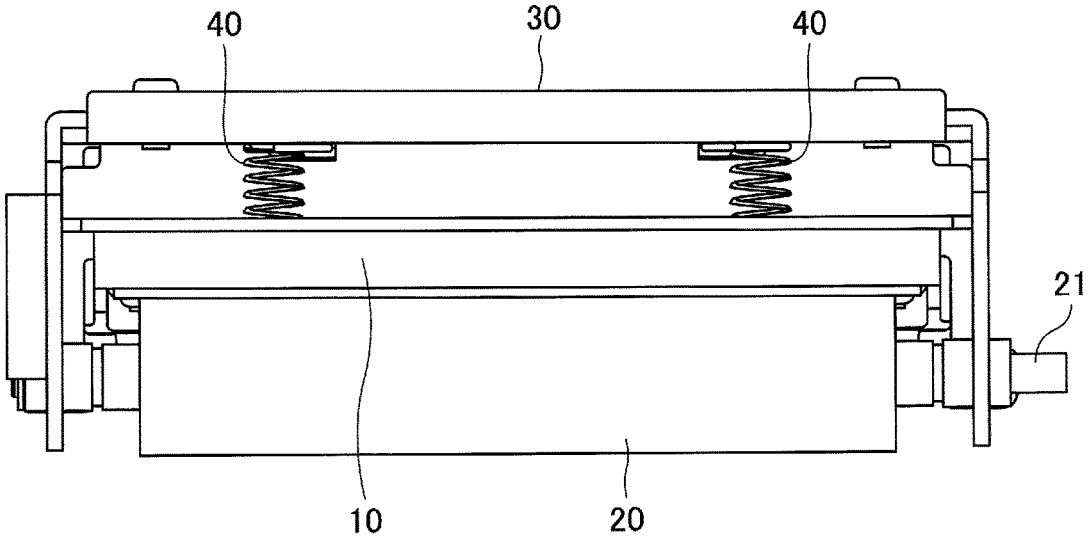
FIG. 1 is a front view of a printer.

A printer of FIG. 1 includes a print head 10, a platen roller 20, a frame 30, and a head spring 40. The print head 10 is pressed toward the platen roller 20 by the head spring 40 placed between the print head 10 and the frame 30.

The print head 10 of a thermal printer is a thermal head in which a heating element generates heat. The print head 10 comes in contact with a recording sheet, so that the face of the print head 10 may be worn out due to repeated printing. When printing on a label sheet with adhesive, the adhesive may stick to the print head 10, and is hardened by the heat of the print head 10 to become difficult to remove. Other contamination may also become attached to the adhesive and become difficult to remove. The print head is thus replaced as such a need arises.

Since the print head 10 is pressed toward the platen roller 20 by the head spring 40, removing and installing of the print head 10 for the replacement is time-consuming. If the head spring 40 needs to be removed when removing the print head 10, the detached head spring 40 may possibly be lost.

In the embodiment described below, a thermal head printer will be described.

Figure 2:
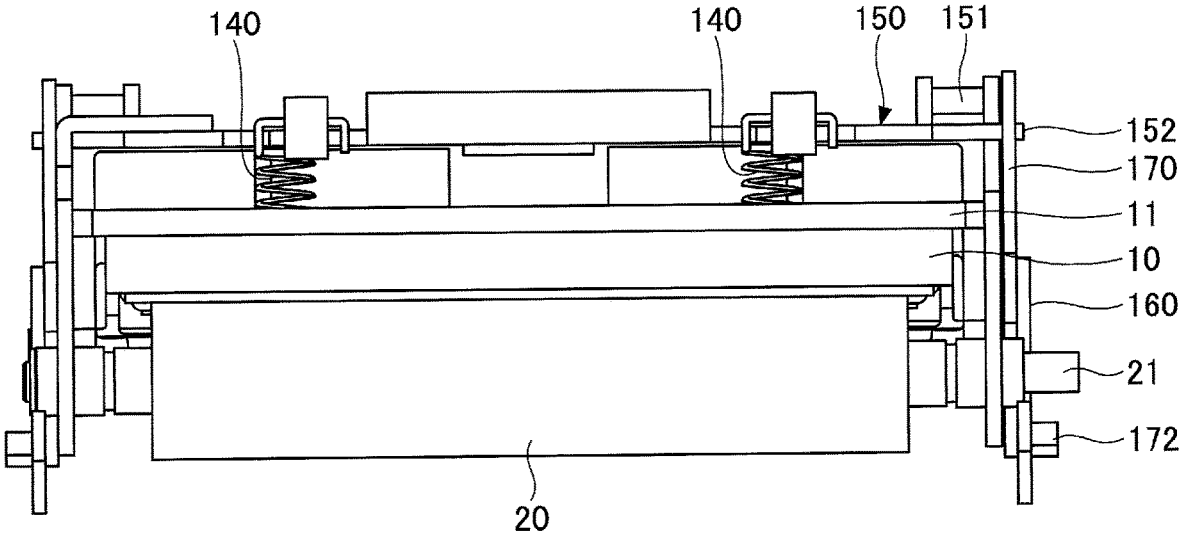
FIG. 2 is a front view of a printer of a first embodiment.
Figure 3:
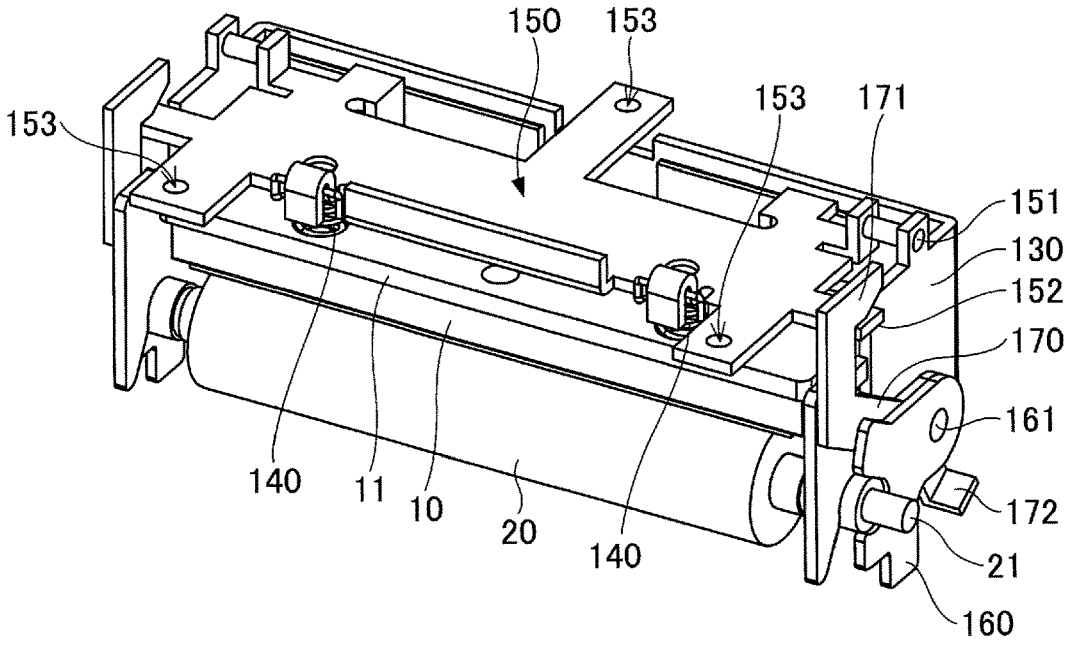
FIG. 3 is an axonometric view of the printer.
Figure 4:
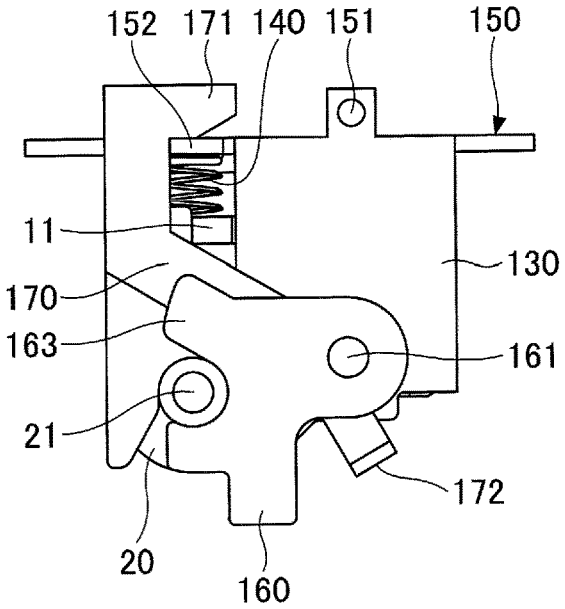
FIG. 4 is a side-elevation view of the printer.

A printer of a first embodiment will be described by referring to FIG. 2 through FIG. 4. FIG. 2 is a front view of the printer of the present embodiment. FIG. 3 is an axonometric view, and FIG. 4 is a side-elevation view.

The printer of the present embodiment includes a print head 10, a platen roller 20, a frame 130, springs 140, a support 150, a lever 160, and arm 170. The platen roller 20 is supported by the frame 130 and the lever 160 so as to be rotatable around a shaft 21, and is removable from the frame 130 by operating the lever 160. The print head 10 has a back face on which a heatsink 11 is mounted, and has a print face situated toward the platen roller 20. The springs 140 pressing the print head 10 are mounted on the face of the support 150 opposing the heatsink 11 to urge the print head 10 toward the platen roller 20. A recording sheet is conveyed by the platen roller 20 for printing while sandwiched between the print head 10 and the platen roller 20. In the present embodiment, one end of each of the springs 140 is hooked on the hook of the print head 10 so as not to be detached from the support 150.

The support 150 is mounted on the frame 130 so as to be rotatable around a shaft 151. Projections 152 on the opposite ends of the support 150 are engaged with engaging parts 171 of the arm 170, so that an upward movement of the support 150 is prevented. With the projections 152 being engaged with the engaging parts 171, the springs 140 are sandwiched between the support 150 and the heatsink 11, and are thus in a compressed state.

The lever 160 and arm 170 are mounted on the frame 130 so as to be rotatable around a shaft 161. The rotation axis of the arm 170 is the same as the shaft 161. The arm 170 may be referred to as a hold unit. The print head 10 and the heatsink 11 are collectively referred to as a head unit.

The procedure of removing the print head 10 will be described. The lever 160 is rotated in order to remove the print head 10.

Figure 5:
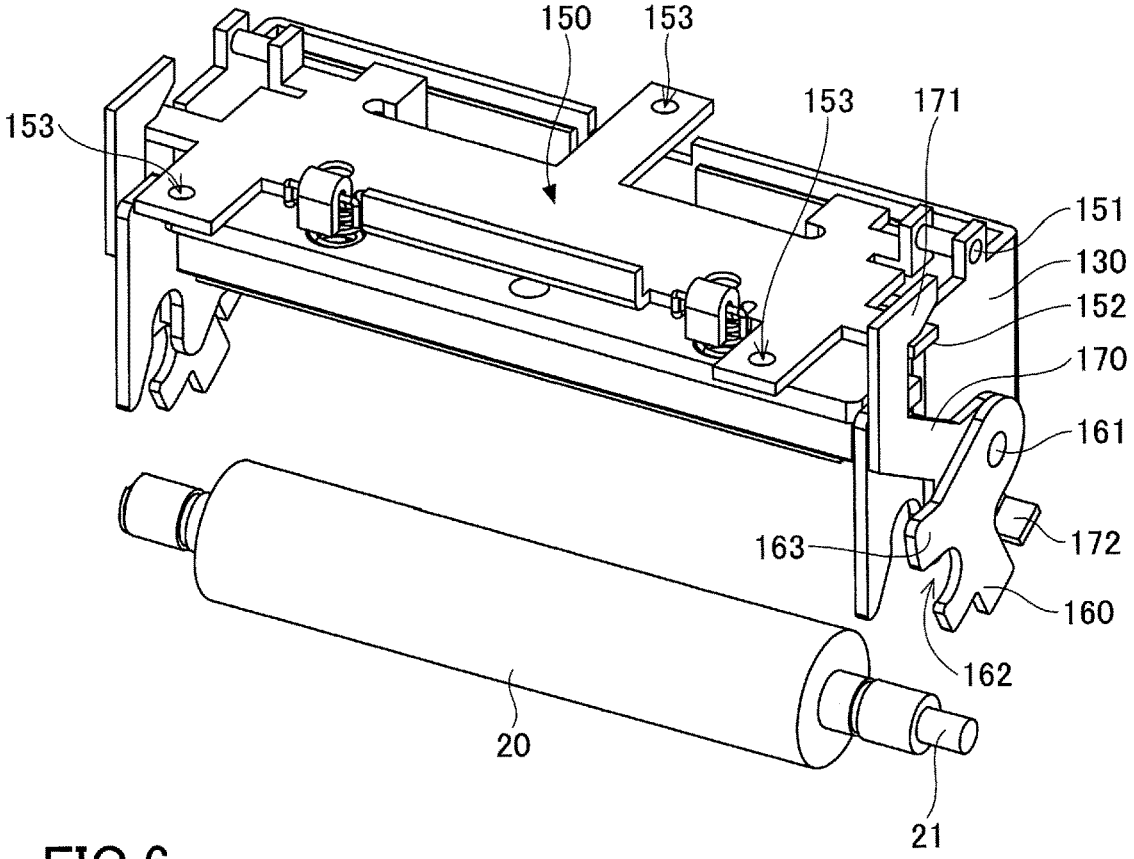
FIG. 5 is an axonometric view illustrating the handling of the printer.
Figure 6:
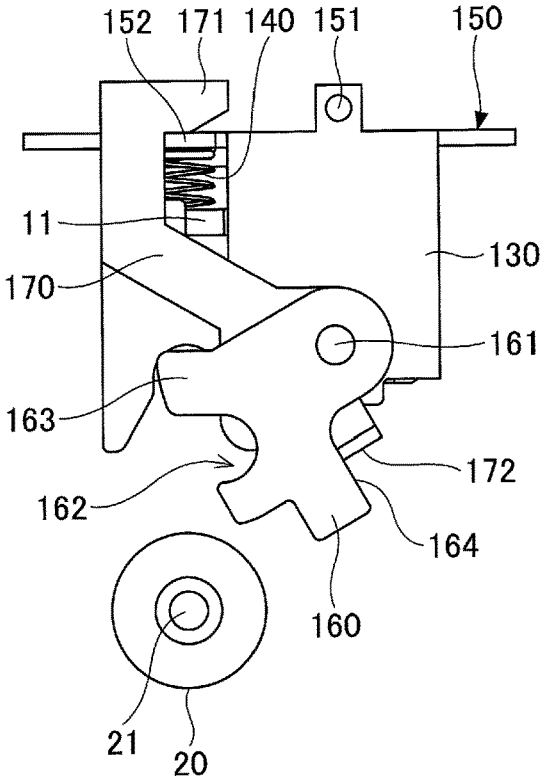
FIG. 6 is a side-elevation view illustrating the handling of the printer.

When the lever 160 is rotated counterclockwise from the state illustrated in FIG. 4, the platen roller 20 supported by an opening 162 of the lever 160 is pushed downward by a protrusion 163 so as to be disengaged as illustrated in FIG. 5 and FIG. 6. In this state, a side edge 164 of the lever 160 is in contact with a projection 172 of the arm 170. Since the arm 170 is not yet rotated, the projection 152 still stays engaged with the engaging part 171. The engaging part 171 is situated at one end of the arm 170, and the projection 172 is situated at the opposite end of the arm 170.

Figure 7:
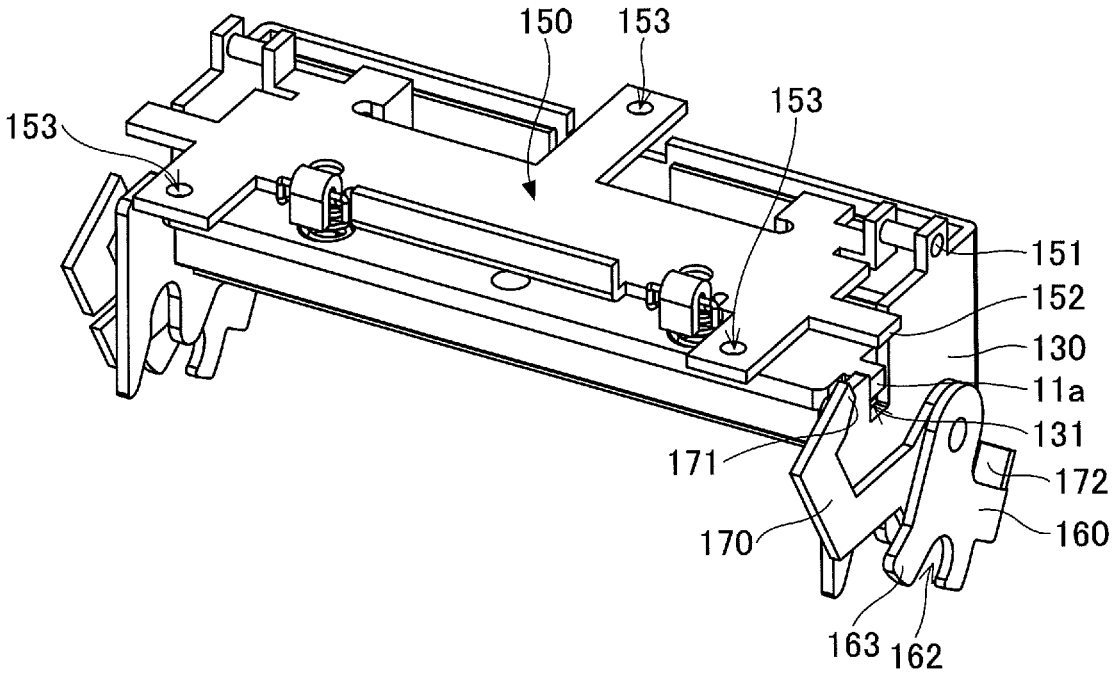
FIG. 7 is an axonometric view illustrating the handling of the printer.
Figure 8:
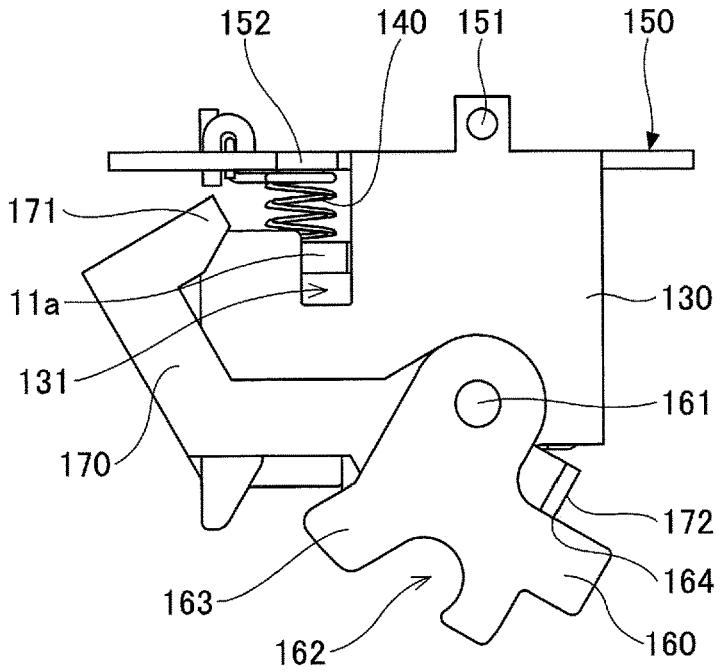
FIG. 8 is a side-elevation view illustrating the handling of the printer.
Figure 9:
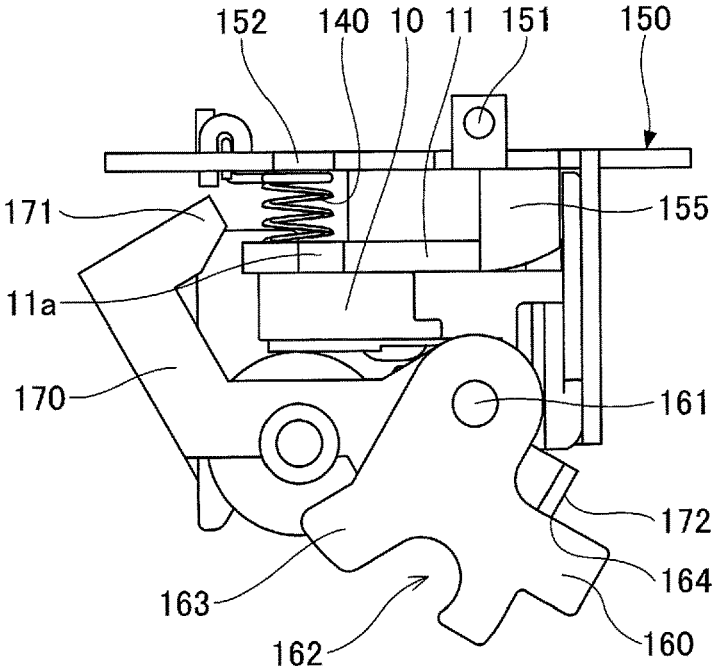
FIG. 9 is an illustrative drawing illustrating the handling of the printer.
Figure 10:
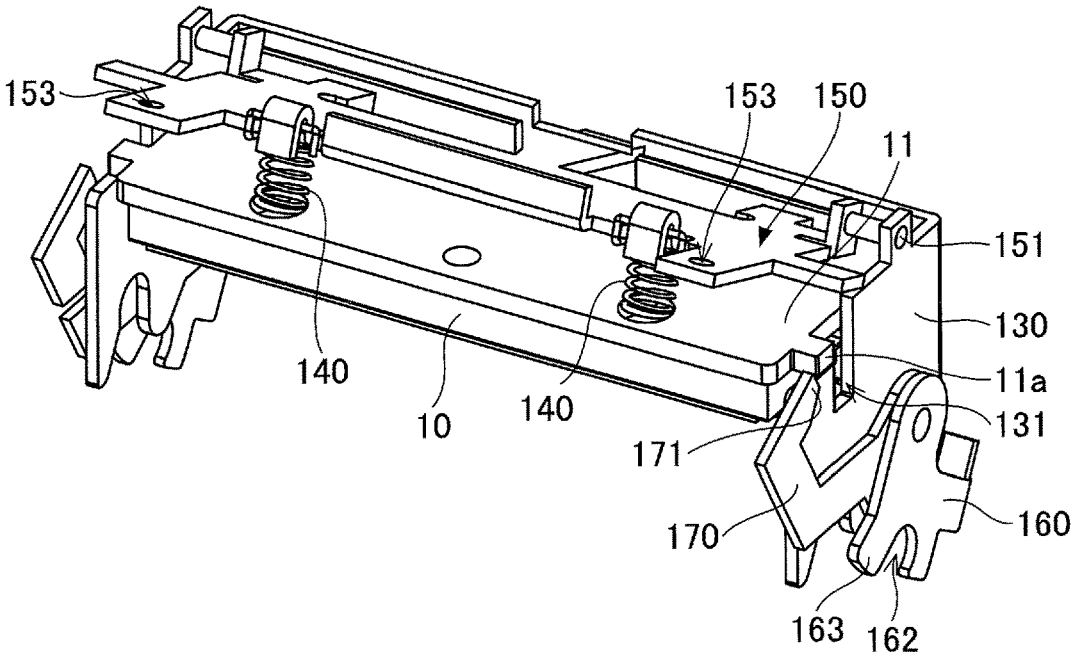
FIG. 10 is an axonometric view illustrating the handling of the printer.
Figure 11:
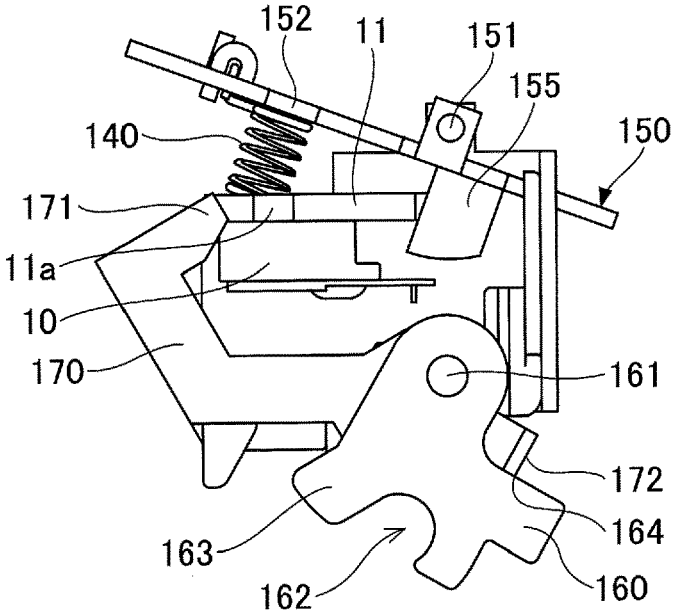
FIG. 11 is an illustrative drawing illustrating the handling of the printer.

When the lever 160 is further rotated counterclockwise from the state illustrated in FIG. 6, the projection 172 in contact with the side edge 164 is pressed and the arm 170 rotates as illustrated in FIG. 7 through FIG. 9. FIG. 9 is a side-elevation view in which part of the frame 130 is removed. When the engaging part 171 is disengaged from the projection 152, an urging force exerted by the springs 140 pushes the support 150 upwards, so that the support 150 rotates around the shaft 151. As a result, the print head 10 is no longer pressed by the springs 140, and the head unit is removed. FIG. 11 is a side-elevation view in which part of the frame 130 is removed.

As illustrated in FIG. 9 and FIG. 11, the face of the support 150 on which the springs 140 are mounted has a protrusion 155. As the arm 170 rotates to trigger a clockwise movement of the support 150, the protrusion 155 raises the heatsink 11 upward, allowing an easier removal of the print head 10.

With the print head 10 being attached to the frame 130, the projections 11*a* of the heatsink 11 provided at opposite ends are seated in openings 131. A rotational of the support 150 causes the protrusion 155 to come in contact with the right-side end of the heatsink 11 in FIG. 11 to raise the heatsink 11 upward. As a result, the projections 11*a* exit from the openings 131, which makes it easier to remove the print head 10.

The springs 140 are fixedly mounted to the support 150 to prevent the head springs 140 from being lost during the replacement of the print head 10.

Figure 12:
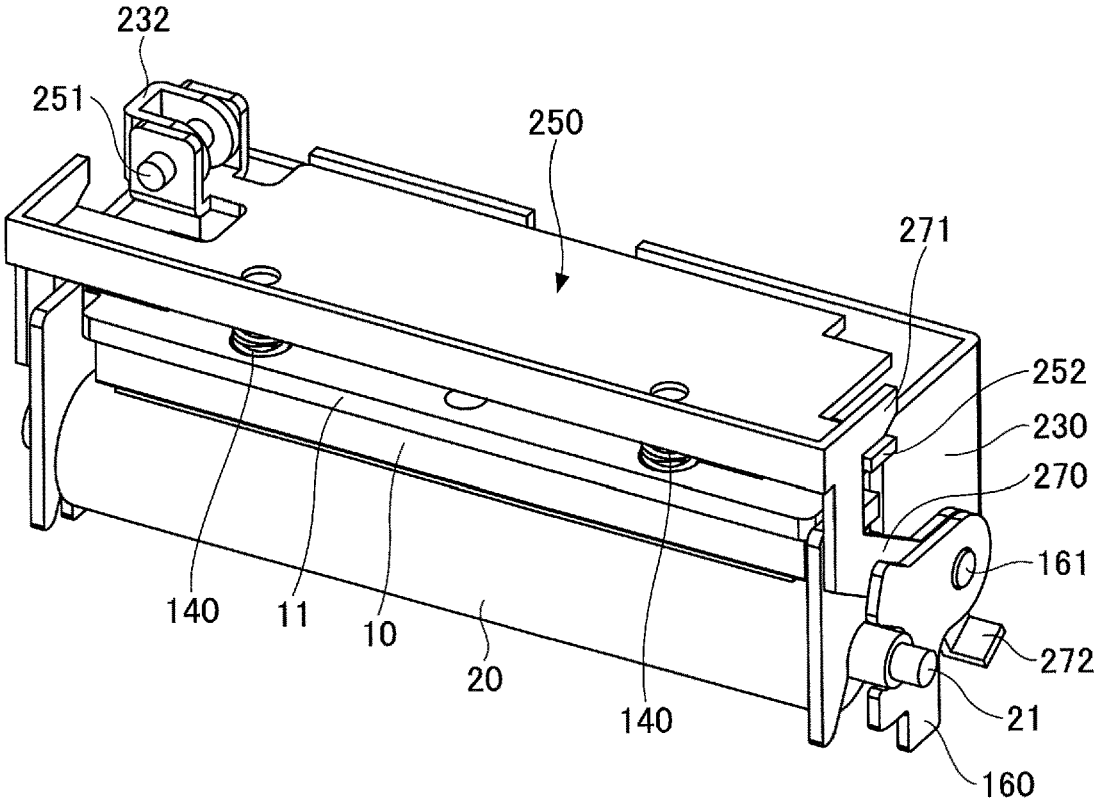
FIG. 12 is an axonometric view of a printer of a second embodiment.
Figure 13:
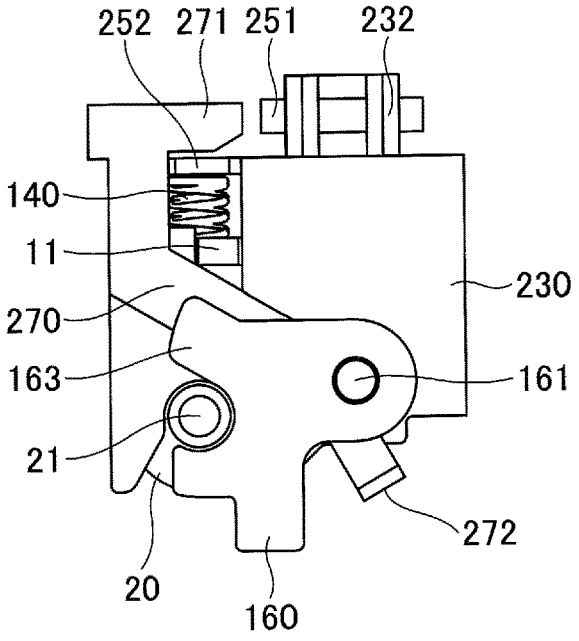
FIG. 13 is a side-elevation view of the printer.

A printer of a second embodiment will be described by referring to FIG. 12 and FIG. 13. FIG. 12 is an axonometric view of a printer of the present embodiment. FIG. 13 is a side-elevation view.

The printer of the present embodiment includes a print head 10, a platen roller 20, a frame 230, head springs 140, a support 250, a lever 160, and an arm 270.

A shaft 251 of the support 250 is rotatably supported by a support part 232 of the frame 230. Projections 252 on the opposite ends of the support 250 are engaged with engaging parts 271 of the arm 270, so that an upward movement of the support 250 is prevented. With the projections 252 engaged with the engaging parts 271, the springs 140 sandwiched between the support 250 and the heatsink 11 presses the print head 10 toward the platen roller 20.

In the present embodiment, the lever 160 and the arm 270 are attached to the frame 230 so as to be rotatable around the shaft 161. The rotation axis of the arm 270 is the same as the shaft 161.

The procedure of removing the print head 10 will be described. The lever 160 is rotated in order to remove the print head 10.

Figure 14:
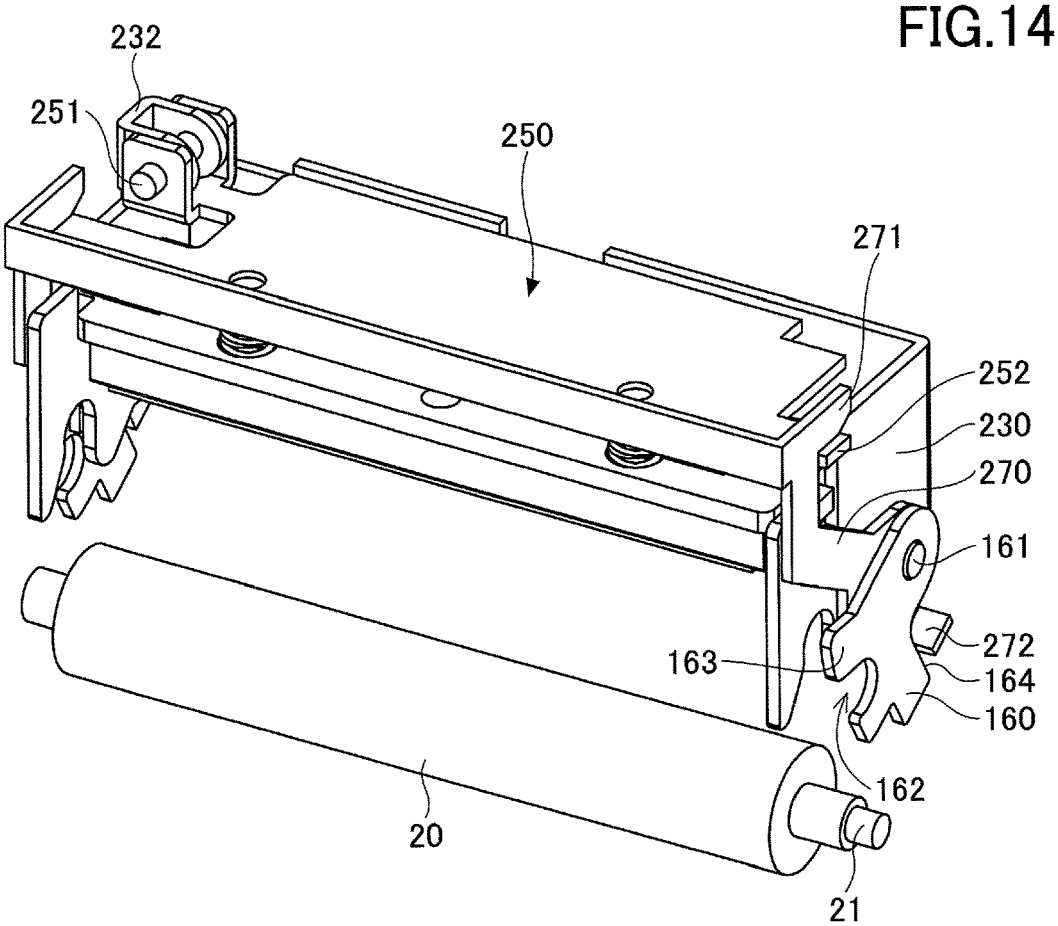
FIG. 14 is an axonometric view illustrating the handling of the printer of the second embodiment.

When the lever 160 is rotated counterclockwise from the state illustrated in FIG. 13, the platen roller 20 supported by an opening 162 is pushed downward by a protrusion 163 situated on the upper side of the opening 162 so as to be disengaged as illustrated in FIG. 14. In this state, a side edge 164 is in contact with a projection 272 of the arm 270. Since the arm 270 is not yet rotated, the projection 252 still stays engaged with the engaging part 271. The engaging part 271 is situated at one end of the arm 270, and the projection 272 is situated at the other end of the arm 270.

Figure 15:
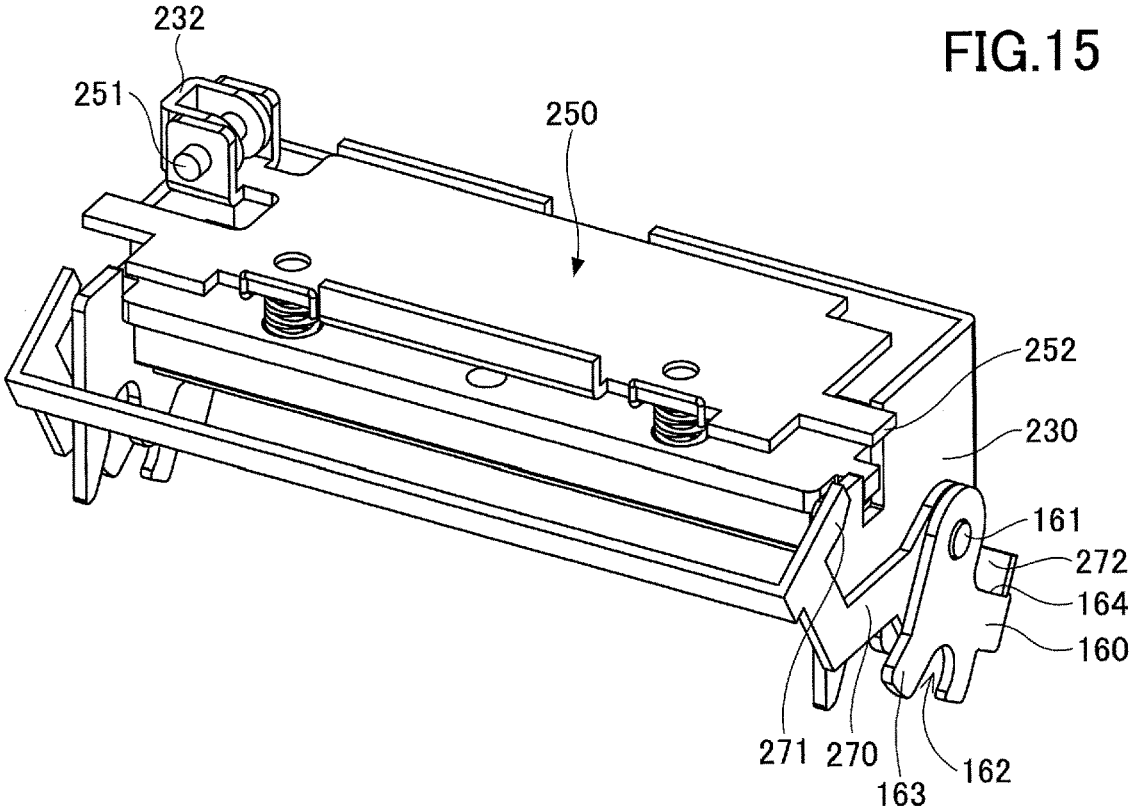
FIG. 15 is an axonometric view illustrating the handling of the printer.
Figure 16:
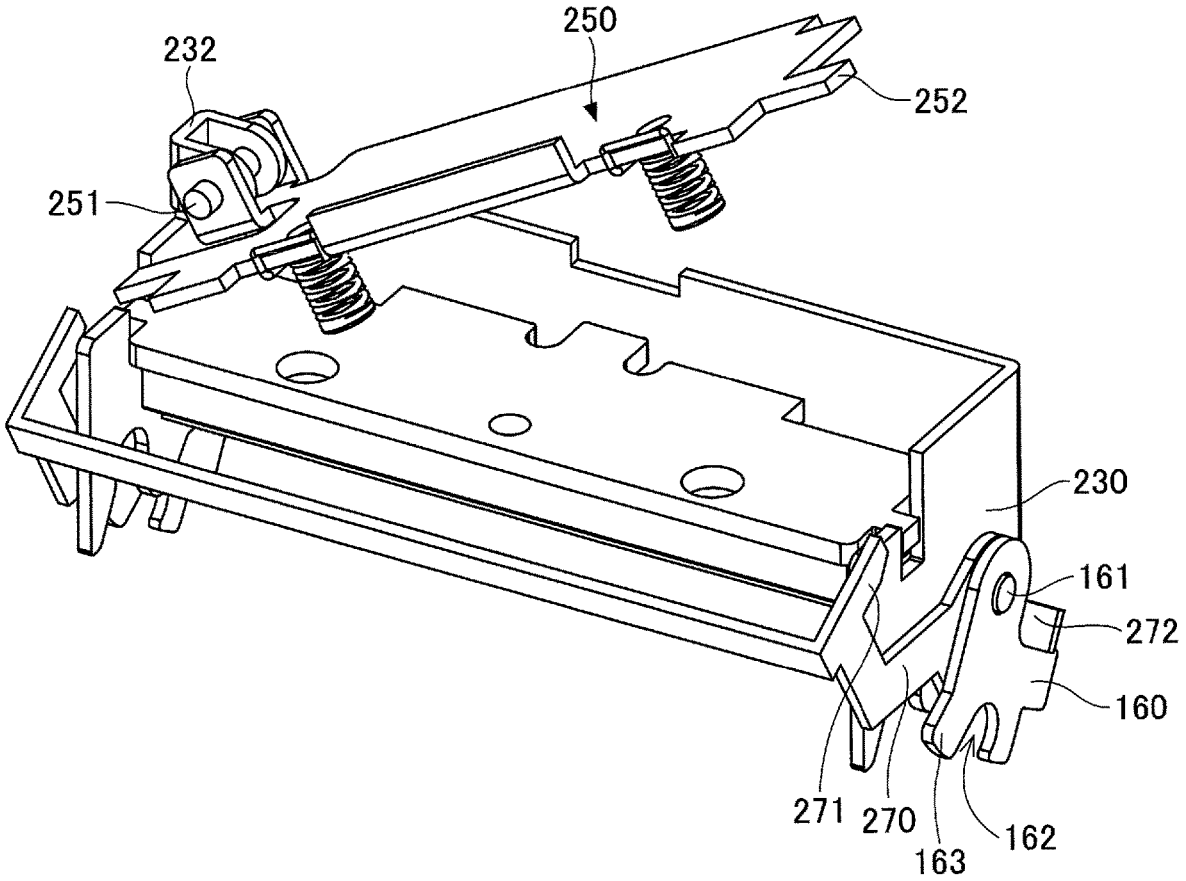
FIG. 16 is an axonometric view illustrating the handling of the printer.

When the lever 160 is further rotated counterclockwise from the state illustrated in FIG. 14, the projection 272 in contact with the side edge 164 is pressed, and the arm 270 rotates counterclockwise as illustrated in FIG. 15. As a result, the engaging part 271 is disengaged from the projection 252, so that the support 250 rotates as illustrated in FIG. 16 upon being pressed upwards by the springs 140. The urging force of the springs 140 pressing the print head 10 is thus removed, and the head unit can be easily removed.

Configurations and features other than those described above are the same as or similar to those of the first embodiment.

Figure 17:
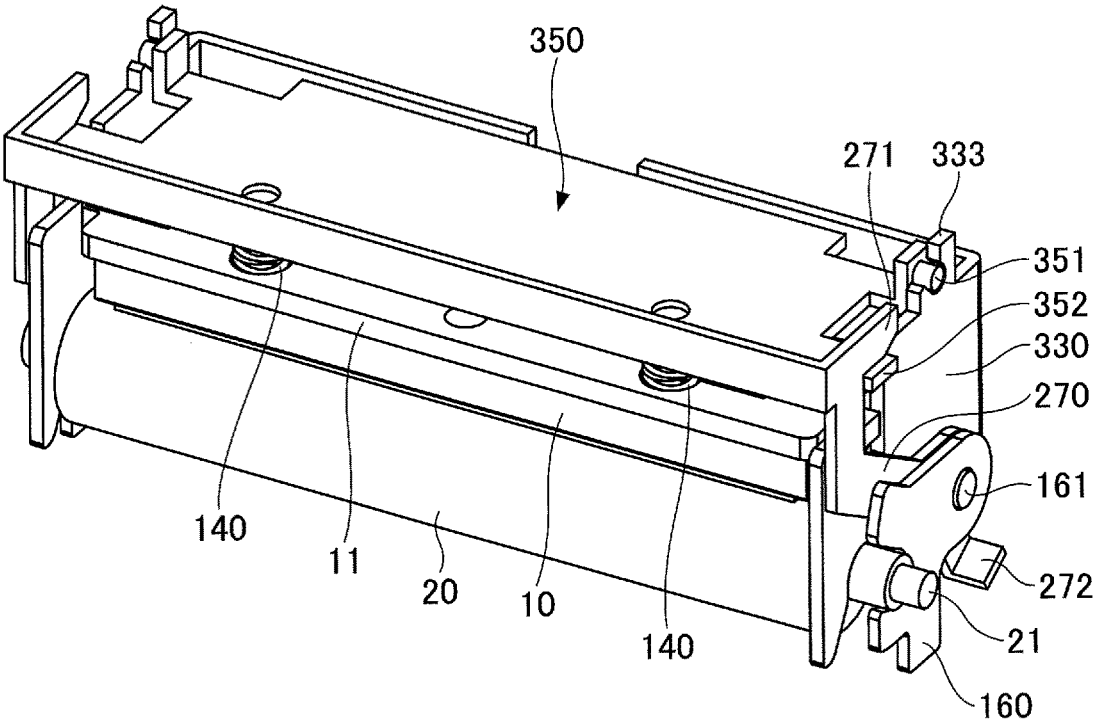
FIG. 17 is an axonometric view of a printer of a third embodiment.
Figure 18:
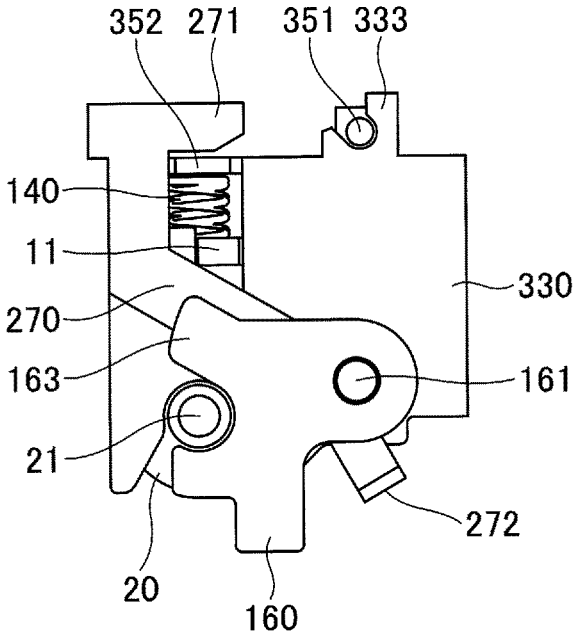
FIG. 18 is a side-elevation view of the printer.

A printer of a third embodiment will be described by referring to FIG. 17 and FIG. 18. FIG. 17 is an axonometric view of a printer of the present embodiment. FIG. 18 is a side-elevation view.

The printer of the present embodiment includes a print head 10, a platen roller 20, a frame 330, head springs 140, a support 350, a lever 160, and an arm 270.

The support 350 has a first projection 351 and a second projection 352 at either side end thereof. The first projection 351 which is provided at either side end of the support 350 is engaged with an engaging part 333 of the frame 330. The second projection 352 which is provided at either side end of the support 350 is engaged with an engaging part 271 of the arm 270. This arrangement prevents an upward movement of the support 350. With the second projection 352 being engaged with the engaging part 271, the springs 140 are sandwiched between the support 350 and the heatsink 11 to press the print head 10 toward the platen roller 20.

The procedure of removing the print head 10 will be described. The lever 160 is rotated in order to remove the print head 10.

Figure 19:
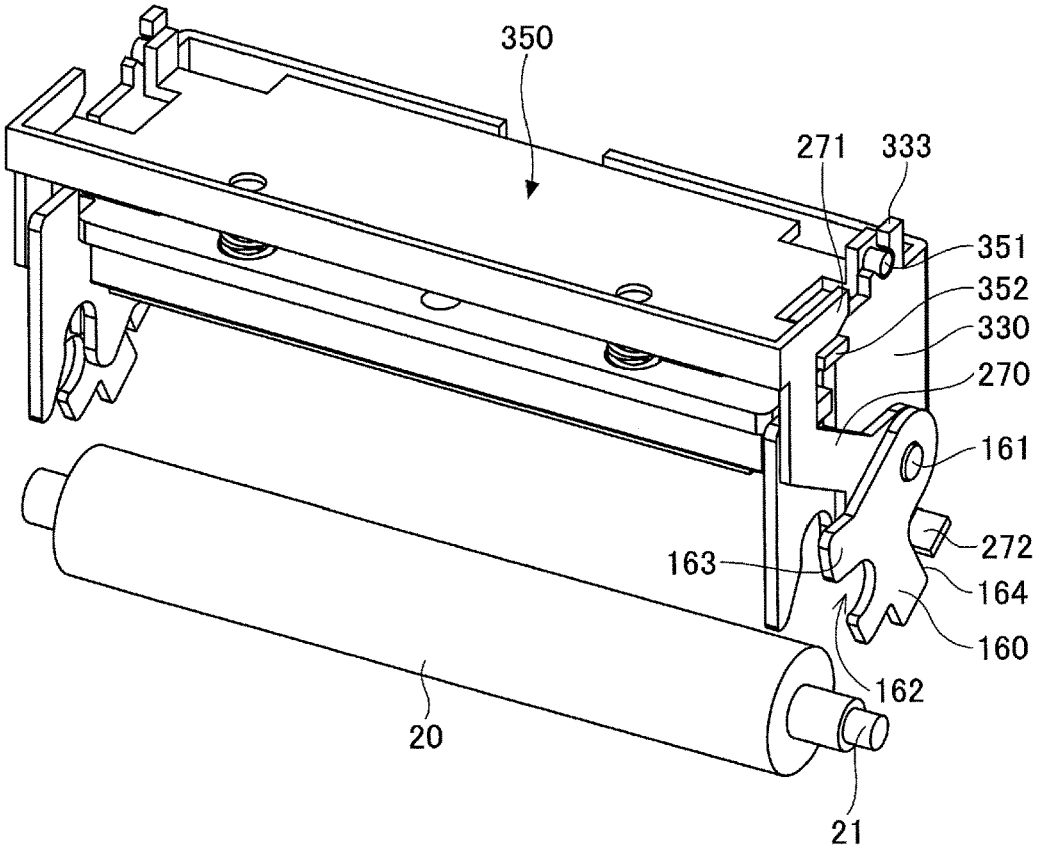
FIG. 19 is an axonometric view illustrating the handling of the printer of the third embodiment.
Figure 20:
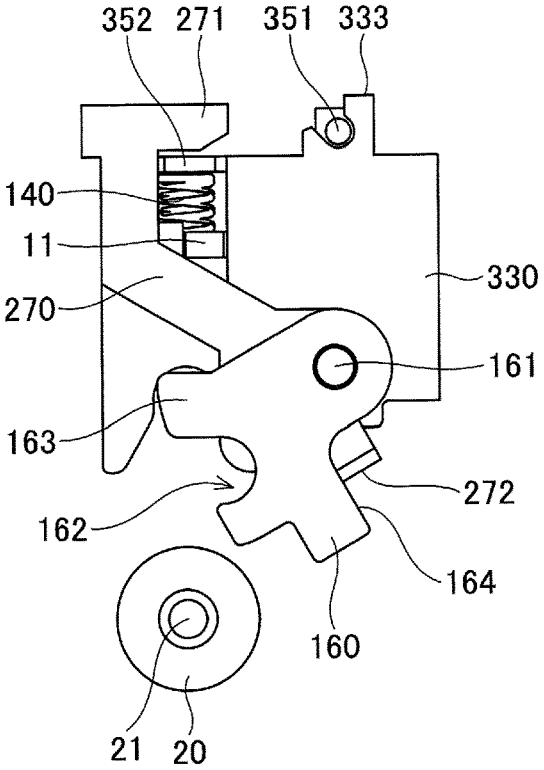
FIG. 20 is a side-elevation view illustrating the handling of the printer.

When the lever 160 is rotated counterclockwise from the state illustrated in FIG. 18, the platen roller 20 supported by an opening 162 is pushed downward by a protrusion 163 so as to be disengaged as illustrated in FIG. 19 and FIG. 20. In this state, a side edge 164 is in contact with a projection 272 of the arm 270. Since the arm 270 is not yet rotated, the second projections 352 on the opposite side ends still stay engaged with the engaging parts 271.

Figure 21:
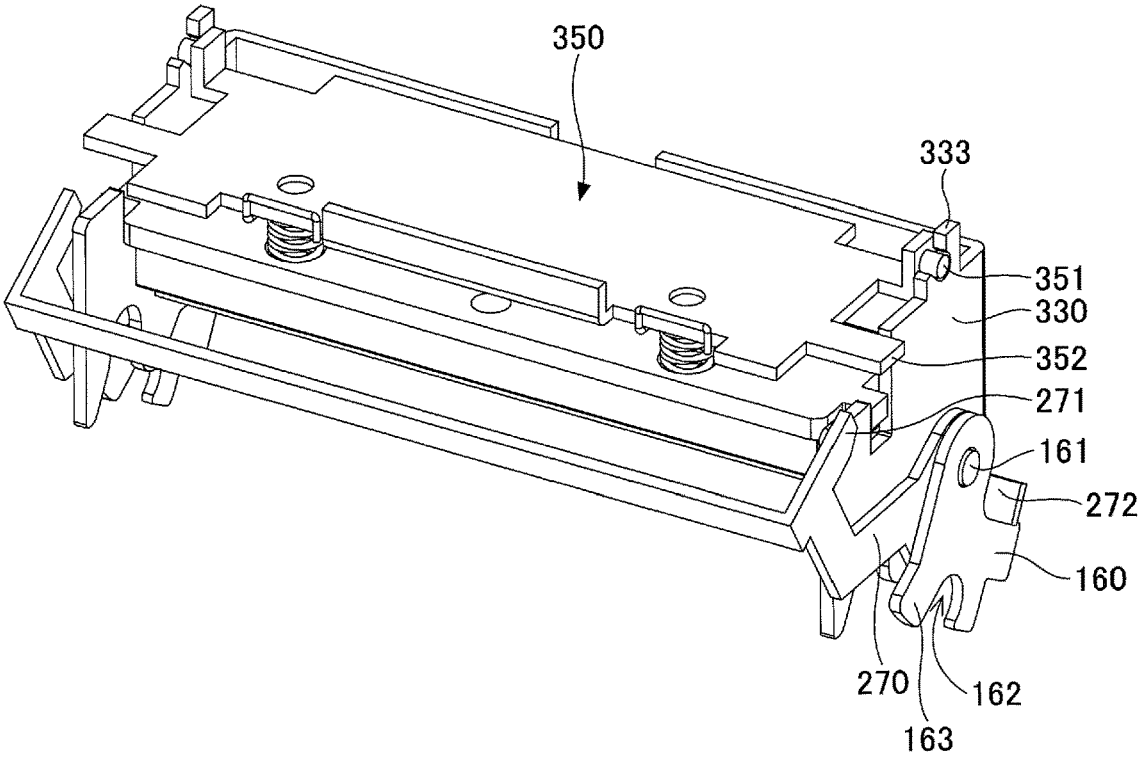
FIG. 21 is an axonometric view illustrating the handling of the printer.
Figure 22:
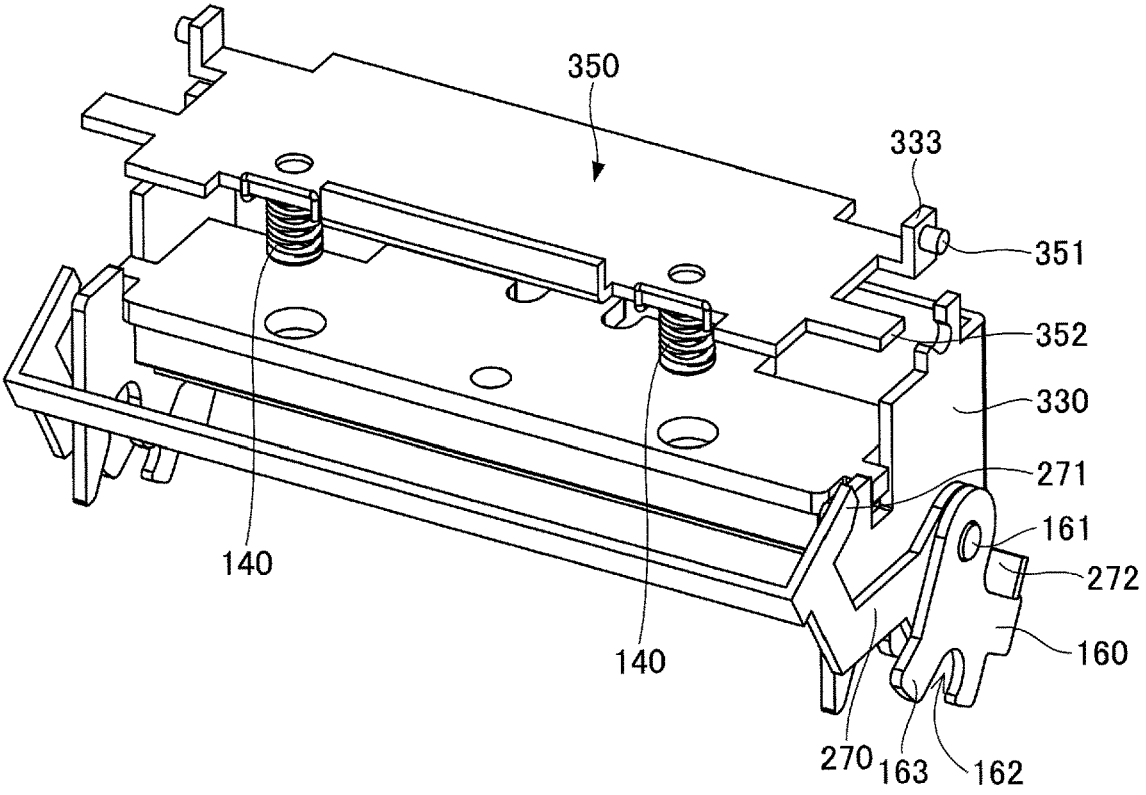
FIG. 22 is an axonometric view illustrating the handling of the printer.

When the lever 160 is further rotated counterclockwise from the state illustrated in FIG. 20, the projection 272 in contact with the side edge 164 is pressed, and the arm 270 rotates counterclockwise as illustrated in FIG. 21. As a result, the engaging part 271 is disengaged from the second projection 352, so that the support 350 is free to move toward the upper left side. As illustrated in FIG. 22, thus, the support 350 pressed by the head springs 140 is separated and detached as the first projection 351 exits from the opening of the engaging part 333. The urging force of the springs 140 is thus removed, and the head unit is easily removed.

Configurations other than those described above are the same as or similar to those of the first or second embodiment.

Figure 23:
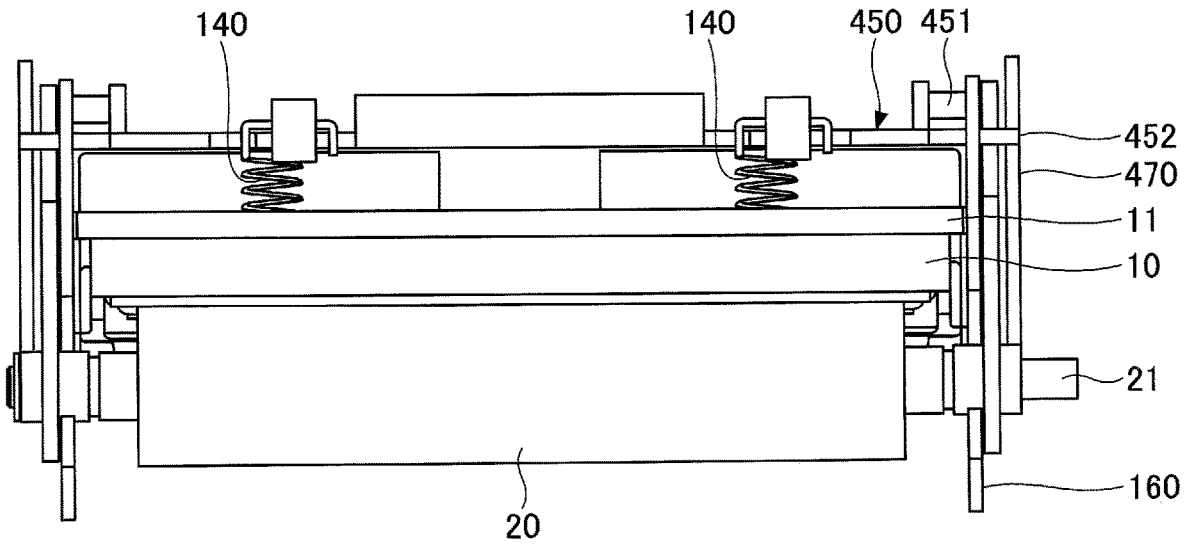
FIG. 23 is a front view of a printer of a fourth embodiment.
Figure 24:
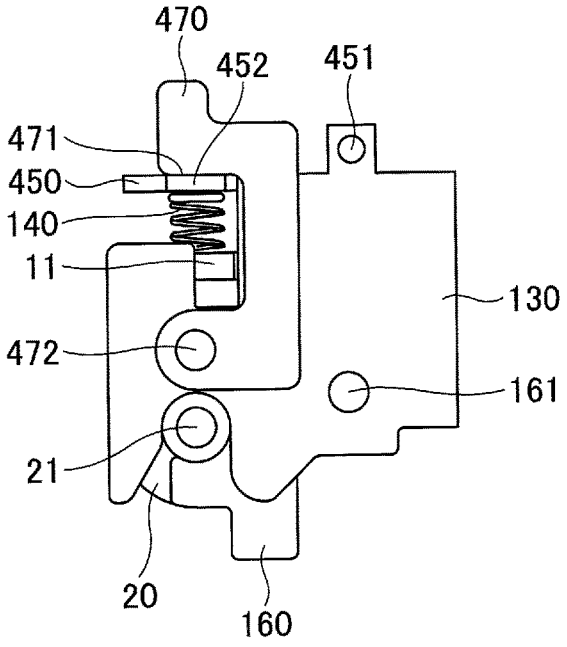
FIG. 24 is a side-elevation view of the printer.

A printer of a fourth embodiment will be described by referring to FIG. 23 and FIG. 24. FIG. 23 is a front view of a printer of the present embodiment. FIG. 24 is a side-elevation view.

In the present embodiment, the print head 10 can be removed by operating only a lever 470. The lever 470 is an example of a hold unit.

The printer of the present embodiment includes a print head 10, a platen roller 20, a frame 130, head springs 140, a support 450, a lever 160, and a lever 470 for holding the support 450.

The support 450 is mounted on the frame 130 so as to be rotatable around a shaft 451. Projections 452 provided at the opposite ends of the support 450 are engaged with engaging parts 471 of the lever 470, so that an upward movement of the support 450 is prevented. With the projections 452 engaged with the engaging parts 471, the springs 140 sandwiched and compressed between the support 450 and the heatsink 11 presses the print head 10 toward the platen roller 20.

Figure 25:
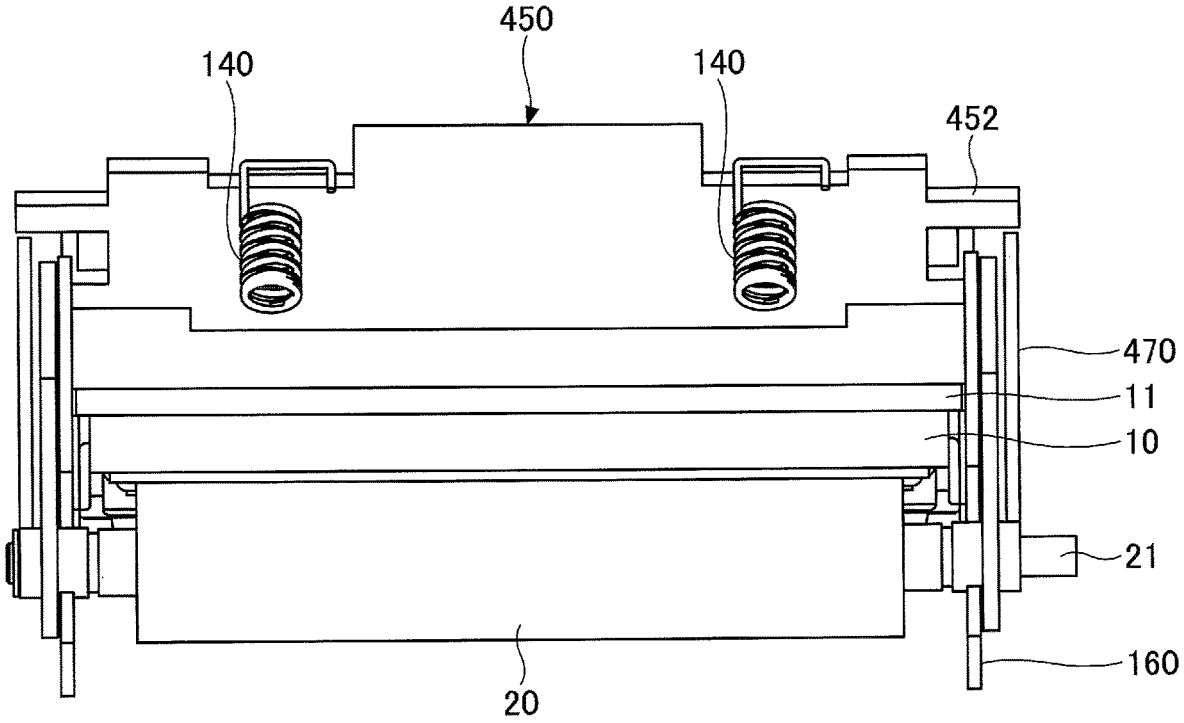
FIG. 25 is a front view illustrating the handling of the printer.
Figure 26:
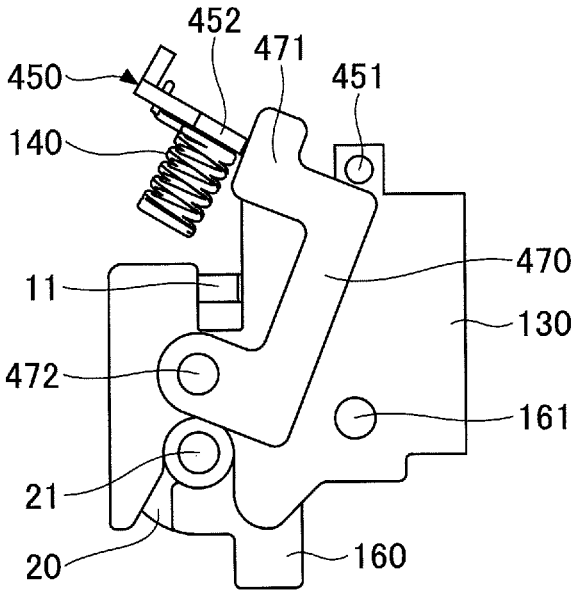
FIG. 26 is a side-elevation view illustrating the handling of the printer.

The procedure of removing the print head 10 will be described. The lever 470 is rotated clockwise in order to remove the print head 10. In response, the engaging part 471 is disengaged from the projection 452, so that the support 450 rotates as illustrated in FIG. 25 and FIG. 26 upon being pressed upwards by the springs 140. The urging force of the springs 140 to press the print head 10 is thus removed, which allows the head unit to be easily removed.

Configurations and features other than those described above are the same as or similar to those of the first embodiment. The configuration of the present embodiment is also applicable to the second and third embodiments.

Figure 27:
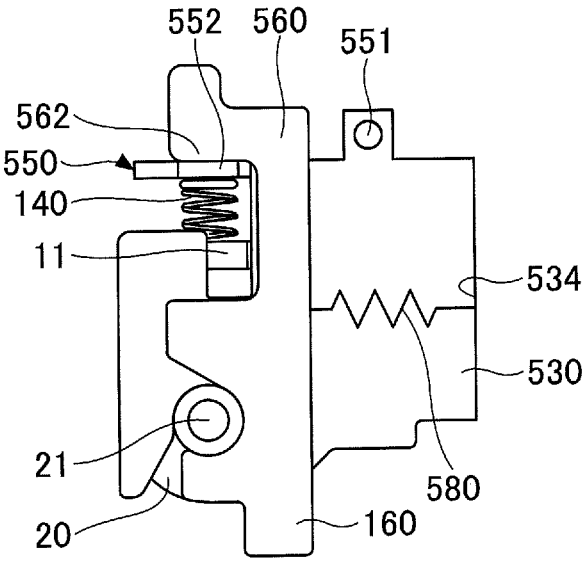
FIG. 27 is a side-elevation view of a printer of a fifth embodiment.

A printer of a fifth embodiment will be described by referring to FIG. 27 through FIG. 29.

The printer of the present embodiment includes a print head, a platen roller 20, a frame 530, head springs 140, a support 550, a lever 560, and a spring 580. The lever 560 has an opening 561 at one side thereof for supporting the platen roller 20, and has an engaging part 562 at the other side thereof for engaging with a projection 552 of the support 550. One end of the spring 580 has one end is connected to a part 534 of the frame 530 and the other end thereof is connected to the lever 560. In FIG. 27, the spring 580 is in a compressed state, so that the lever 560 is urged to the left in the figure by the spring 580.

The platen roller 20 is supported by the frame 530 and the lever 560 so as to be rotatable around a shaft 21. The springs 140 mounted to the face of the support 550 opposing the heatsink 11 presses the print head toward the platen roller 20.

The support 550 is mounted on the frame 530 so as to be rotatable around a shaft 551. Projections 552 provided at the opposite ends of the support 550 are engaged with engaging parts 562, so that an upward movement of the support 550 is prevented. With the projections 552 engaged with the engaging parts 562, the springs 140 compressed between the support 550 and the heatsink 11 presses the print head toward the platen roller 20.

Figure 28:
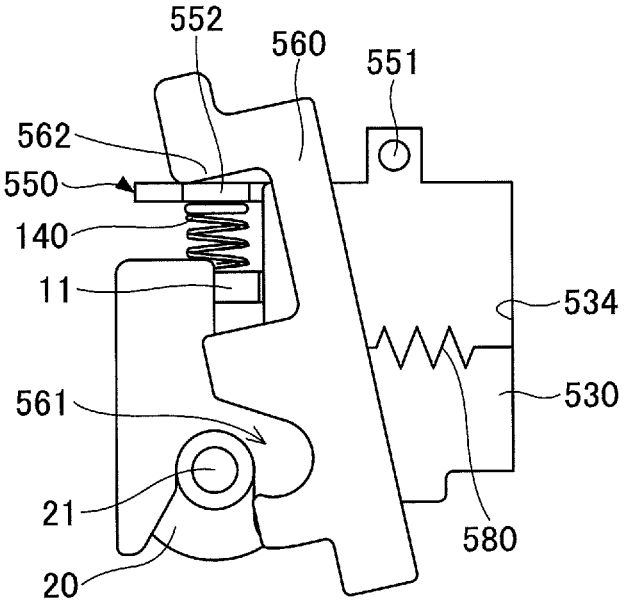
FIG. 28 is an illustrative drawing of the printer of the fifth embodiment.

In order to remove the platen roller 20, the lower side of the lever 560 is moved to the right as shown in FIG. 28. As a result, support for the platen roller 20 is removed, and the platen roller 20 exits from the opening 561, which allows the platen roller 20 to be removed.

Figure 29:
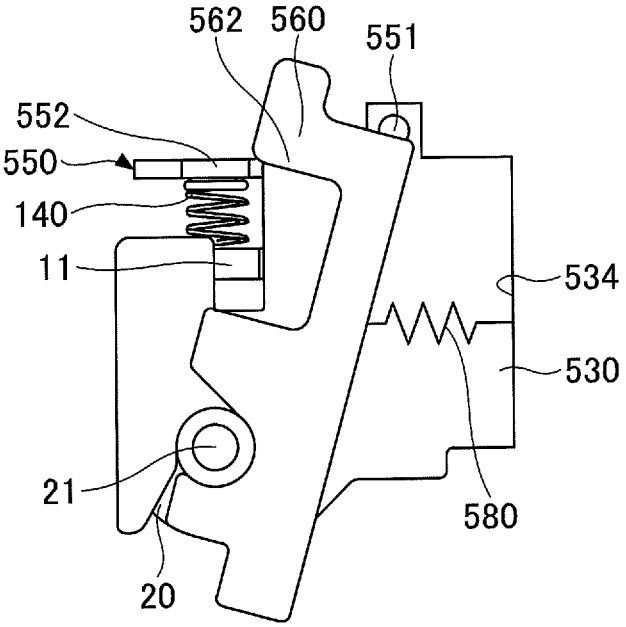
FIG. 29 is an illustrative drawing of the printer.

In order to remove the print head, the upper side of the lever 560 is moved to the right as illustrated in FIG. 29, and the engaging part 562 is disengaged from the projection 552. The support 550 is thus pushed upward by the springs 140, and is rotated. The urging force of the springs 140 is thus removed, and the head unit can be easily removed.

Configurations and features other than those described above are the same as or similar to those of the first embodiment.

Further, although a description has been given with respect to one or more embodiments of the present invention, the contents of such a description do not limit the scope of the invention.

The present application is based on and claims priority to Japanese patent application No. 2019-012839 filed on Jan. 29, 2019, with the Japanese Patent Office, the entire contents of which are hereby incorporated by reference.

What is claimed is:

1. A printer comprising:

a print head configured to print on a recording sheet;

a platen roller rotatably attached to a frame;

a support having a head spring attached thereto that urges the print head toward the platen roller, the support having a projection extending from a side end thereof;

an arm rotatably attached to the frame and having an engaging part that engages with the projection situated at the side end of the support; and a lever movable separately from the arm and rotatably attached to the frame to cause the platen roller to be secured to the frame, the lever being configured to rotate to allow the platen roller to be detached from the frame, wherein the lever and the arm are situated alongside each other on a same lateral side of the frame, and a rotation axis of the lever is the same as a rotation axis of the arm, wherein the head spring urges the print head toward the platen roller when the projection of the support is engaged with the engaging part of the arm, and wherein the arm is configured to be rotated such that rotation of the arm causes the engaging part of the arm to disengage from the projection extending from the side end of the support.

2. The printer as claimed in claim 1, wherein the support is attached to the frame in a rotatable manner, and the support is urged by the head spring to rotate upon the projection being disengaged from the engaging part.

3. The printer as claimed in claim 1, wherein the support is urged by the head spring to be separated from the frame upon the projection being disengaged from the engaging part.

4. The printer as claimed in claim 1, wherein the arm has a second projection, and the lever is configured to rotate to come in contact with the second projection, so that the arm is rotated upon being pressed by the lever.

* * * * *